US005384046A

United States Patent [19]

Lotter et al.

[11] Patent Number: 5,384,046

[45] Date of Patent: Jan. 24, 1995

[54] SCREEN ELEMENT

[75] Inventors: Frank Lotter; Waldemar R. Knodel, both of Pentling, Germany

[73] Assignee: Heinrich Fiedler GmbH & Co KG, Germany

[21] Appl. No.: 186,059

[22] Filed: Jan. 24, 1994

Related U.S. Application Data

[63] Continuation of Ser. No. 817,062, Jan. 6, 1992, abandoned.

[30] Foreign Application Priority Data

Jul. 2, 1991 [DE] Germany ..... 4121896

[51] Int. Cl.[6] ..... B01D 29/05; B01D 35/28; B07B 1/46

[52] U.S. Cl. ..... 210/484; 210/477; 210/483; 210/497.01; 210/497.2; 210/498; 209/397; 209/399

[58] Field of Search ..... 210/477, 484, 483, 459, 210/164, 166, 232, 340, 497.01, 415, 497.2, 478, 479, 480, 481, 482, 451, 323.1, 498; 209/353, 352, 399, 397

[56] References Cited

U.S. PATENT DOCUMENTS

| | | |
|---|---|---|
| 1,923,138 | 8/1933 | Boynton . |
| 2,253,692 | 8/1941 | De Grave . |
| 2,371,760 | 3/1945 | Kinney . |
| 2,956,683 | 10/1960 | Kinney . |
| 3,275,151 | 9/1966 | Carr . |
| 3,713,541 | 1/1973 | Nelson . |
| 4,846,971 | 7/1989 | Lanort . |
| 4,995,978 | 2/1991 | Van de Gang . |

*Primary Examiner*—Thomas M. Lithgow
*Attorney, Agent, or Firm*—Henry M. Feiereisen

[57] ABSTRACT

A screen element or screen basket for sorting and classifying a fluid flow, in particular for treatment of fiber suspensions or for mechanical purification of molasses, includes a screen insert having a support screen for taking up forces or loads during operation and a plurality of screen inserts which are provided with classifying openings. The screen inserts are detachably secured to the support screen allowing individual replacement during wear or damage.

5 Claims, 2 Drawing Sheets

SCREEN ELEMENT

This is a continuation of application Ser. No. 07/817,062 filed Jan. 6,1992 (now abandoned).

BACKGROUND OF THE INVENTION

The present invention refers to a screen element for sorting and classifying a fluid flow, in particular for use in the paper industry for treating suspensions or for mechanical purification of molasses in the sugar industry. In particular, the invention refers to a screen element which is provided with classifying openings at the side facing the incoming fluid flow and with bores at the other side which extend over a plurality of classifying openings and are in communication therewith.

It is known to make the walls of screen elements in sandwich construction by combining a thin fine screen with a support screen. Screen elements of this type have the drawback that the perforations in the fine screen in the area of the webs of the support screen are not utilized.

EP-PS 14 66 41 describes a screen basket which is provided at one side thereof with classifying openings of small diameter and at the other side thereof with bores of largerdiameter which are in communication with the classifying openings. Such a screen basket requires relatively complicated and cumbersome repair work in case the fine screen becomes defective. Moreover, since the fine screen is fixedly secured to the support screen, an adjustment of the perforations or classifying openings to suit varying demands upon classification and sorting is limited.

SUMMARY OF THE INVENTION

It is an object of the present invention to provide an improved screen element obviating the afore-stated drawbacks.

In particular, it is an object of the present invention to provide an improved screen element which allows considerably facilitated maintenance, repair and replacement of the fine screen, and yet permits selection of classifying openings best suited for the respective sorting or classifying task.

These objects, and others which will become apparent hereinafter are attained in accordance with the present invention by providing the screen element with a support screen which includes the bores, and a plurality of individual screen inserts which are securely placed in recesses of the support screen and accommodate the classifying openings.

Suitably, the mid-axis of the bores and the recesses in the support screen may extend coaxially or at an angle relative to each other. The screen inserts may preferably be configured in form of flat plates but may also be of cup-shaped configuration, with the classifying openings advantageously provided in form of slots along the cup-shaped wall of the screen inserts. The top surface of the screen inserts may be flush with the upper surface of the support screen or may be recessed relative thereto.

According to a further embodiment of the invention, the screen inserts may be arranged at an acute angle relative to the upper surface of the support screen. The screen inserts may be configured in any suitable shape, for example of circular or rectangular configuration, with the long sides as well as the short sides of the rectangle facing the incoming fluid flow.

By allowing selective design of the screen insert and selective placement of the screen insert relative to the support screen, a screen element can be chosen best suited to cope with changing demands of sorting and classifying fluid flows. Screen inserts, which for example are subjected to great stress and are greatly worn off, damaged or destructed, can separately be replaced. By arranging the screen inserts recessed or at an angle to the upper surface of the support screen, the screen area can easily be made irregular for generating turbulences of the incoming fluid flow and thus for preventing clogging. Further, by aligning the screen inserts in direction of flow of the material to be screened, the throughput and overall efficiency can be considerably increased. The screen element in accordance with the invention is especially suitable for those applications in which the screen element has great wall thickness to enable it to withstand great strain but still is provided with small screening openings.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
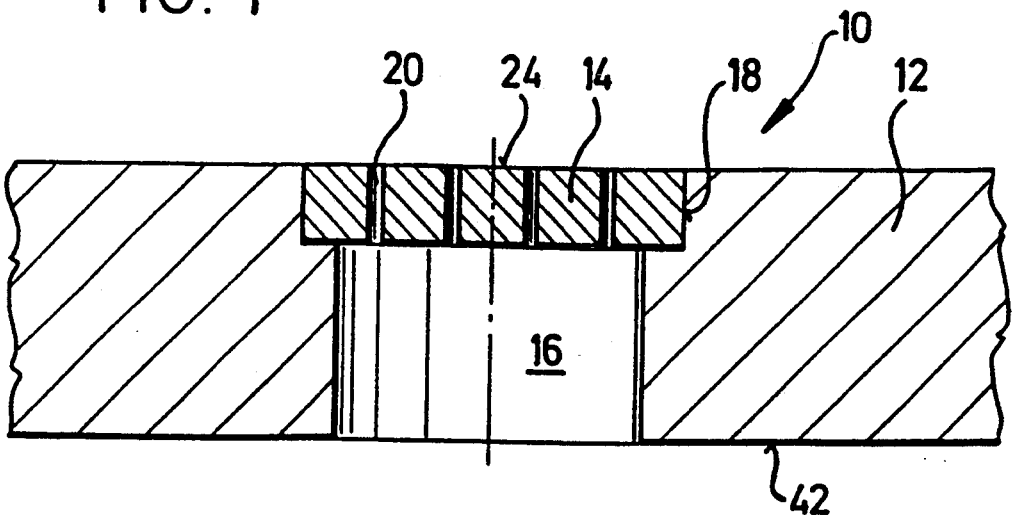
FIG. 1 is a schematic fragmentary sectional view of one embodiment of a screen element in accordance with the present invention.

Throughout all the Figures, the same or corresponding elements are always indicated by the same reference numerals.

Referring now to the drawing and in particular to FIG. 1, there is shown a schematic fragmentary sectional view of a screen element according to the invention for classifying and sorting a fiber flow. e.g. fiber suspensions. For ease of illustration, only a wall section of the screen element or screen basket is depicted in detail in order to describe embodiments of the present invention. It will be appreciated by persons skilled in the art that the screen element contains more mechanical apparatus which does not appear in the drawing. For example, the screen element may include a rotor by which the fiber suspensions are advanced towards the screen openings. However, this apparatus, like other necessary apparatus, is not part of the invention, and has been omitted from the figures for the sake of simplicity.

The screen element is generally designated by reference numeral 10 and includes a support screen 12 and a plurality of individual screen inserts 14. The support screen 12 is provided with a plurality of grooves or bores 16 (only one groove 16 is shown) which are of circular cylindrical configuration. Persons skilled in the art will understand that different geometrical configurations are conceivable as well.

Each bore 16 extends from the downstream end face 42 of the support screen 12 toward the upstream end face 22 thereof and opens into a recess 18 which receives the screen insert 14 at the side (upstream side) facing the flow of fiber suspension. As shown by the various examples in FIG. 1, 2, 3 and 5, the screen insert 14 is shaped in form of a plate which is suitably connected to the support screen 12. For example, the screen insert 14 may be snugly fitted or pressed in the support screen 12 or may be welded therewith. However, a detachable connection between the screen insert 14 and the support screen 12 is preferred in order to allow individual replacement of single screen inserts 14 when being worn off or damaged.

Each plate-shaped screen insert 14 is provided with a plurality of classifying openings in form of parallel perforations 20. For sake of simplicity, the drawing shows the classifying openings 20 of cylindrical configuration, however, it will be appreciated that these openings may also be of different configuration.

The width or thickness of the screen insert 14 may range for example from 0.1 to 10 mm, however, other dimensions are certainly conceivable as well. The width of the perforations or openings 20 in the screen inserts 14 may range for example from 0.1 to 1 mm. The width of the support screen 12 is selected in dependence on the stress, but should be greater than the width of the screen insert 14.

Figure 2:
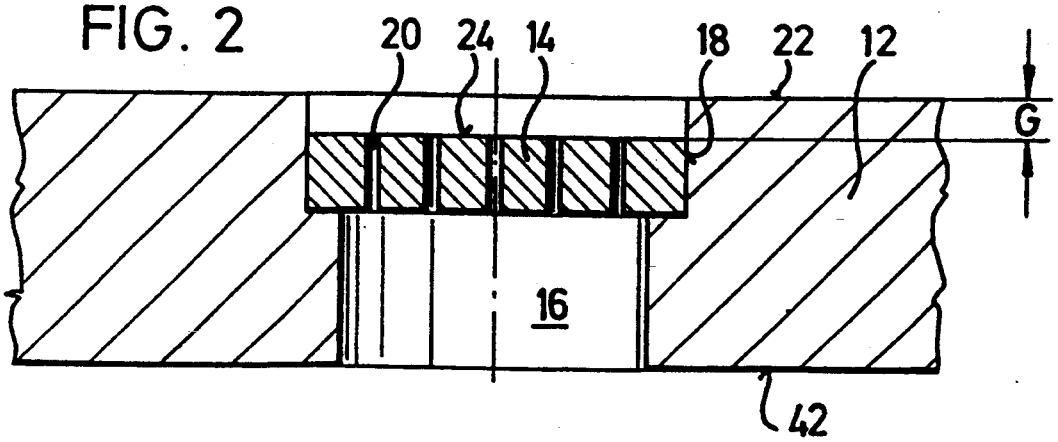
FIGS. 2 and 3 show modifications of the screen element according to FIG. 1.
Figure 3:
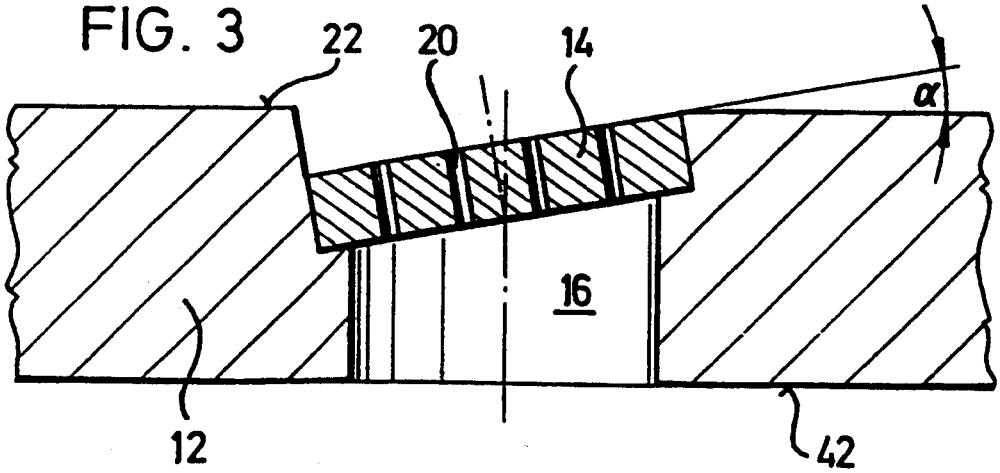

As shown in FIG. 1, the screen insert 14 has a top surface 24 which is flush with the upstream end face 22 of the support screen 12. However, as shown in FIG. 2, the top surface 24 may also be recessed by a distance G relative to the end face 22 of the support screen 12 to thereby provide the screen element 10 with an irregular screen area for generating and reinforcing turbulences upon the incoming flow of suspension. In this manner, clogging of the classifying openings 20 is eliminated or at least significantly diminished.

In accordance with the embodiments of FIGS. 1 and 2, the center axis of the bore 16 and the center axis of the recess 18 extend coaxially to each other. In the embodiments according to FIGS. 3 and 5, the center axis of the bore 16 and the center axis of the recess 18 extend at an angle a relative to each other by slantingly placing the plate-shaped screen inserts 14 relative to the end face 22 of the support screen 12. In this manner, the screen element 10 is provided with an irregular screen area to cause or reinforce turbulences upon the incoming flow of fiber suspension. The angle a by which the screen insert 14 is slanted relative to the end face 22 of the support screen 12 may range from 10° to 30°, however, it will be appreciated by persons skilled in the art that the range is made by way of example only.

Figure 5:
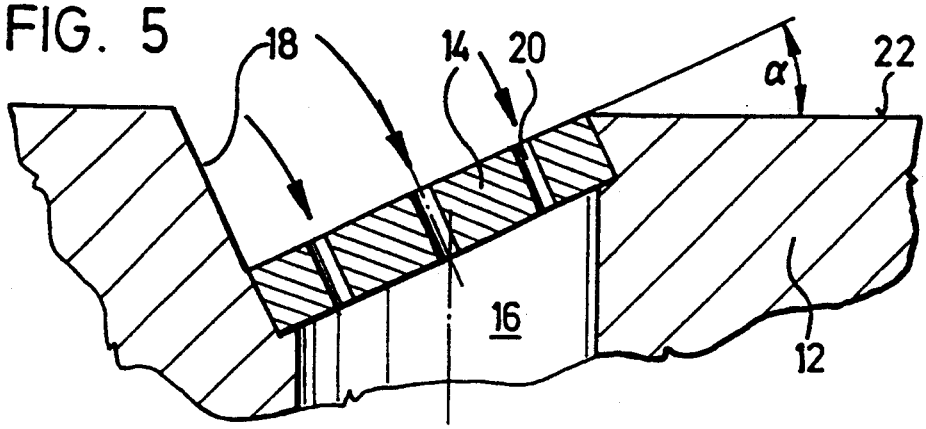
FIG. 5 shows a schematic fragmentary sectional view of the screen element according to FIG. 3, illustrating in detail a slanted screen insert oriented in flow direction of the material to be sorted.

FIG. 5 shows an embodiment of a screen element 10 in which the screen insert 14 is slanted relative to the end face 22 of the support screen 12 by an angle a ranging from 25° to 40°, especially from 30° to 35°. As indicated by the arrows, by increasing the inclination, the screen insert 14 and the classifying openings 20 can be aligned with the flow direction of the material to be screened so as to allow increase of the flow rate through the screen element 10.

Figure 4:
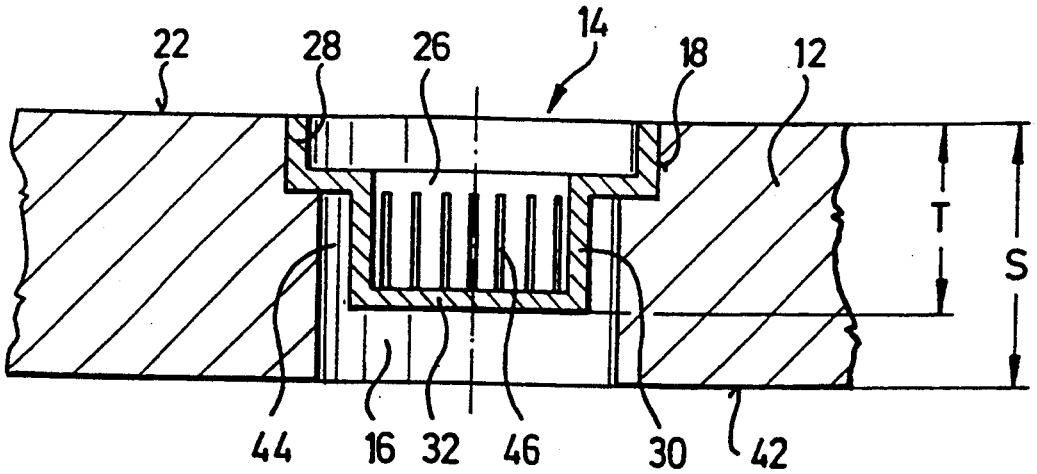
FIG. 4 is a schematic fragmentary sectional view of another embodiment of a screen element according to the invention.

Turning now to FIG. 4 there is shown a schematic fragmentary sectional view of another embodiment of a screen insert 14 which is configured in shape of a cup 26, with its top part 28 being securely fitted in the recess 18 of the support screen 12 and with its bottom part 30 projecting into the bore 16 of the support screen 12. The bottom part 30 of the cup-shaped screen insert 14 has an outer diameter which is smaller than the inner diameter of the bore 16 so that an annular space 44 is defined therebetween. As further shown in FIG. 4, the wall of the bottom part 30 of the screen insert 14 is provided with axial slots 46 which define the classifying openings 20 and are in communication with the annular space 44. Suitably, these slots 46 extend parallel to the mid-axis of the screen insert 14. Although, FIG. 4 shows the bottom part 30 of the screen insert 14 with a base 32 devoid of openings, it will be appreciated by persons skilled in the art that the bottom 32 may certainly be provided with classifying openings as well.

The screen insert 14 according to FIG. 4 has a depth T which is smaller than the width or thickness S of the support screen 12. It will be understood, however, that the screen insert 14 may be designed in a manner as to extend beyond the downstream end face 42 of the support screen 12. In this case, the depth T of the screen insert 14 exceeds the width of the support screen 12.

During operation, the material to be screened flows from the interior space of the cup-shaped screen insert 14 through the slots 46 into the annular space 44 and finally exits through the bore 16.

As shown in the drawing, in all embodiments of the screen element 10, the bore 16 extends over a plurality of classifying openings 20. According to a non-limiting example of the present invention, the circular bores 16 may have a diameter between about 15 to 50 mm. It will be appreciated by persons skilled in the art that even though the description of the drawing refers to the surface 22 as being the upstream side and to the surface 42 as being the downstream side, it should be understood that this is done by way of example only, and can certainly be reversed, with surface 42 being the upstream side and surface 22 being the downstream side.

Figure 6:
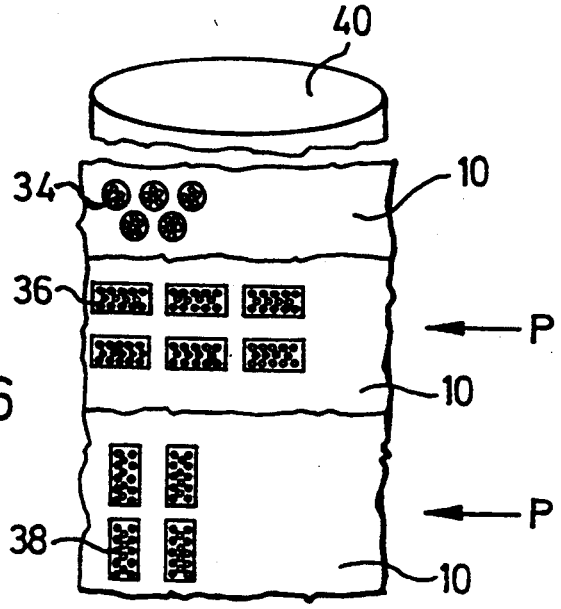
FIG. 6 is a schematic top view of various cross-sectional configurations of a screen insert according to the invention.

Turning now to FIG. 6, there are shown various cross-sectional configurations of screen inserts 14 which are fixedly secured in the support screen 12 and together with the support screen 12 defines the screen element or screen basket 40. The screen inserts 14 may be of circular shape as shown at 34 or may be of rectangular shape as shown at 36 and 38. When configuring the screen insert 14 with rectangular cross section, the short side of the rectangle or the long side of the rectangle may face the incoming material flow to be screened as indicated by arrow P.

While the invention has been illustrated and described as embodied in a screen element, it is not intended to be limited to the details shown since various modifications and structural changes may be made without departing in any way from the spirit of the present invention.

What is claimed as new and desired to be protected by Letters Patent is set forth in the appended claims:

We claim:

1. A screen element for sorting and classifying a fiber suspension, comprising:

a support screen having an upstream side facing the incoming fiber suspension and a downstream side, said support screen including a plurality of recesses at the upstream side, each recess defining a central axis and being extended downstream by a bore at formation of a shoulder, with said bore defining a central axis; and a separate screen insert detachably received in each said recess of said support screen and supported by said shoulder, said screen insert including a selective arrangement of classifying openings to suit the screen element in regard to a sorting and classifying of the fiber suspension and to allow replacement of a single screen insert, said screen insert being slanted at an angle relative to said upstream side of said support screen, with said central axis of said recess extending at an angle relative to said central axis of said bore.

2. A screen element as defined in claim 1 wherein said screen insert is of circular shape.

3. A screen element as defined in claim 1 wherein said screen insert is of rectangular configuration.

4. A screen element as defined in claim 1 wherein said screen insert is of plate-shaped configuration.

5. A screen element as defined in claim 1 wherein said screen insert is of cup-shaped configuration and has a cup-shaped wall which includes slotted classifying openings.

* * * * *